US005440962A

United States Patent [19]

Valtchev

[11] Patent Number: 5,440,962

[45] Date of Patent: Aug. 15, 1995

[54] CLARINET LIGATURE AND GRASPING RING

[76] Inventor: Konstantin L. Valtchev, 43 Cosmic Drive, North York, Ontario, Canada, M3B 3G11

[21] Appl. No.: 248,914

[22] Filed: May 25, 1994

[51] Int. Cl.[6] ..... G10D 9/02

[52] U.S. Cl. ..... 84/383 R

[58] Field of Search ..... 84/383 A, 383 R, 398

[56] References Cited

U.S. PATENT DOCUMENTS

| | | | |
|---|---|---|---|
| 2,292,584 | 8/1942 | Tafarella | 84/383 R |
| 2,837,003 | 6/1958 | Collis | 84/383 |
| 3,202,032 | 8/1965 | Strathmann | 84/383 |
| 4,345,503 | 8/1982 | Runyon | 834/383 |
| 4,428,271 | 1/1984 | Winslow et al. | 84/383 R |
| 4,991,483 | 2/1991 | Petit | 844/383 |
| 5,000,073 | 3/1991 | Hite | 84/383 |
| 5,289,753 | 3/1994 | Rieckhoff | 84/383 R |

*Primary Examiner*—Michael L. Gellner
*Assistant Examiner*—Patrick J. Stanzione
*Attorney, Agent, or Firm*—Henderson & Sturm

[57] ABSTRACT

A clarinet ligature and grasping ring device (10) for use with a mouthpiece/reed assembly (100) wherein the device (110) includes a ligature unit (11) having a reed clamp member (20) and a pair of spring support members (30) operatively joined together in a surrounding relationship with the mouthpiece member (101) of the assembly (100) by an elongated spring member (40); and, a grasping ring unit (12) fixedly secured to the mouthpiece member (101) may be removed from the clarinet barrel member (106) without disturbing the engagement between the ligature unit (11) with the mouthpiece (101).

14 Claims, 2 Drawing Sheets

CLARINET LIGATURE AND GRASPING RING

TECHNICAL FIELD

The present invention relates to the field of ligatures for musical instruments in general, and in particular to a new type of clarinet ligature and grasping ring.

BACKGROUND ART

As can be seen by reference to the following U.S. Pat. Nos. 5,000,073; 4,991,483; 3,202,032; and 2,837,003; the prior art is replete with a myriad and diverse mouthpiece and ligature constructions for musical reed instruments.

While all of the aforementioned prior art constructions are more than adequate for the basic purpose and function for which they have been specifically designed, these patented arrangements do no represent the ultimate design for this type of a device, and as will be explained further on in greater details there is ample room for improvement in this area of technology.

In addition none of the prior art devices contemplate the use of a grasping ring in combination with the ligature and the present invention specifically addresses that particular oversight.

As a consequence of the foregoing situation, there has existed a longstanding need among musicians who play reed instruments for a new type of clarinet ligature and grasping ring which will not only improve the performance of the musical instrument but will permit the musician to remove the mouthpiece without disturbing the ligature; and, the provision of such a construction is a stated objective of the present invention.

DISCLOSURE OF THE INVENTION

Briefly stated, the clarinet ligature and grasping ring device that forms the basis of the present invention comprises in general a grasping ring unit adapted to be secured to the mouthpiece portion of the clarinet mouthpiece assembly, and a ligature unit adapted to engage the clarinet reed.

In addition the ligature unit comprises a reed clamp member and a pair of spring support members which are joined to one another in a surrounding relationship relative to the clarinet mouthpiece assembly by an elongated spring member which is releasably joined together on its opposite ends.

As will be explained in greater detail further on in the specification, the grasping ring unit permits easy removal of the mouthpiece from the barrel of the clarinet without disturbing the ligature. Furthermore the ligature unit possess the following advantages over the prior art. It permits easy vibration of the reed which makes the tone more focused and amplifies the sound. The reed is more sensitive to lip pressure, and sharpening or flattening of the tone can be achieved on a larger scale. The musician can change from the upper to lower register and vice versa very easily and, the reed can be changed very easily by displacing the reed clamp from the reed, pulling the old reed and replacing a new reed, followed by a release of the reed clamp.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
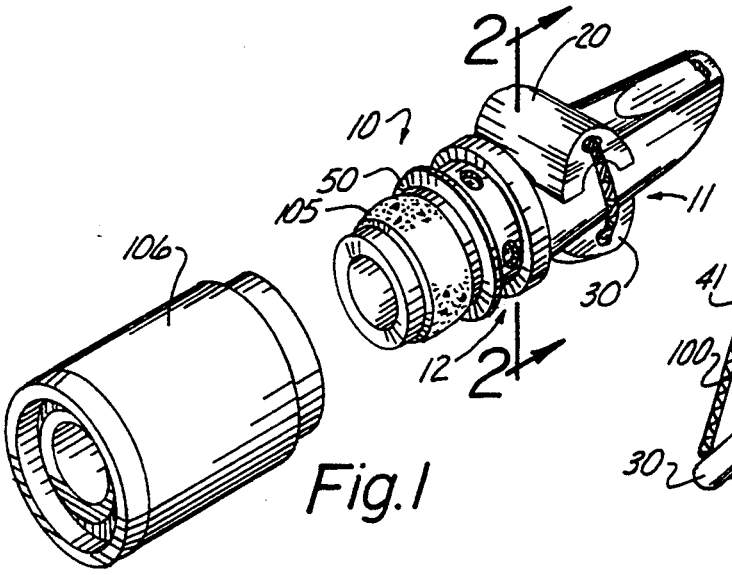
FIG. 1 is a perspective view of the clarinet ligature and grasping ring device that forms the basis of this invention employed on a clarinet mouthpiece assembly.

As can be seen by reference to the drawings, and in particular to FIG. 1, the clarinet ligature and grasping ring device that forms the basis of the present invention is designated generally by the reference numeral (10). The device (10) comprises in general a ligature unit (11) and a grasping ring unit (12) adapted to engage a clarinet mouthpiece reed assembly designated generally as (100). These units will now be described in seriatim fashion.

Before embarking on a detailed description of the ligature unit (11) and grasping unit (12) it would first be advisable to briefly discuss the mouthpiece/reed assembly (100) which the aforementioned units were developed for use in conjunction with.

As can best be appreciated by reference to FIGS. 1 through 4, the mouthpiece/reed assembly (100) comprises a mouthpiece member (101) having a distal end (102) which is filled with a replaceable reed element (103); and a proximal end (104) which terminates in a reduced neck portion (105) which is dimensioned to slideably receive a conventional clarinet barrel member (106).

As shown in FIGS. 1 through 5 and 7, the ligature unit (11) comprises a reed clamp member (20) a pair of spring support members (30) and an elongated spring member (40). The reed clamp member (20) comprises an elongated hollow body (21) having an enlarged generally semi-circular recess (22) formed along its longitudinal axis and a generally shallow transverse recess (23) which has the curvature of the reed disposed generally perpendicular to the longitudinally aligned recess (22) such that the recesses (22)(23) have a cruciform configuration. In addition the reed clamp body (21) is further provided with a discrete bore (24) which is formed proximate the apex of the arched body (21).

Turning now to FIGS. 5and 6, it can be seen that each of the spring support members (30) comprises a slim profile arched body (31) having a semi-circular central recess (32) formed therein and a discrete aperture (33) formed proximate the apex of the arched body (31). In addition the opposite ends (34) of the arched body (31) are curved to conform to the periphery of the clarinet mouthpiece (101) as shown in FIG. 2.

Figure 2:
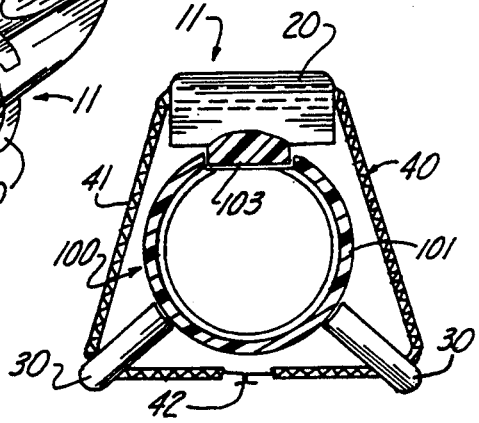
FIG. 2 is a cross-sectional view taken through line 2—2 of FIG. 1.
Figure 5:
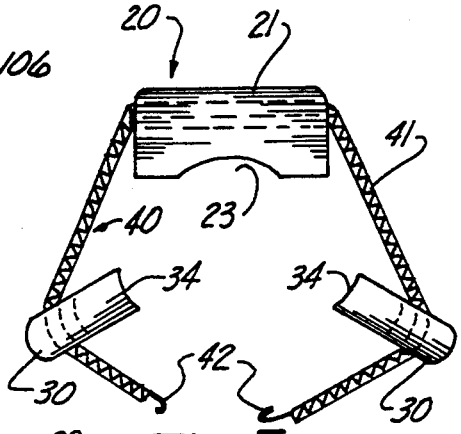
FIG. 5 is an isolated end view of the device prior to engagement with the mouthpiece.

As can best be seen by reference to FIG. 5, the spring member (40) comprises an elongated spring body (41)

dimensioned to be threaded through the elongated bore (24) in the reed clamp member (20) and the discrete apertures (33) in the spring support members (30); wherein, the opposite ends of the spring body (41) are provided with hook elements (42) which are designed to engage one another as illustrated in FIG. 2, for the purpose of engaging the ligature unit (11) to the mouthpiece.reed assembly (100).

Figure 3:
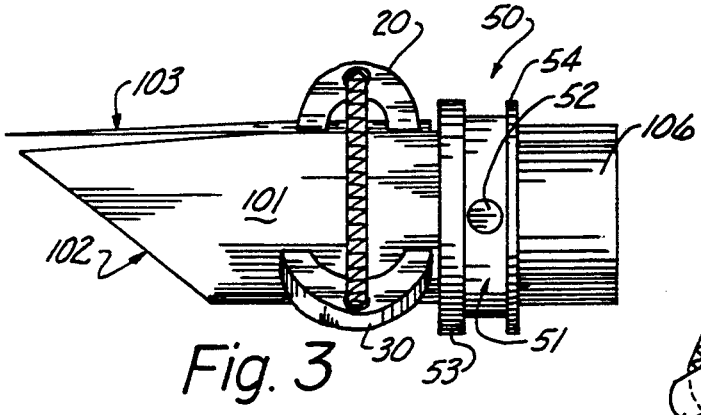
FIG. 3 is a side view of the device installed on the clarinet mouthpiece assembly.
Figure 4:
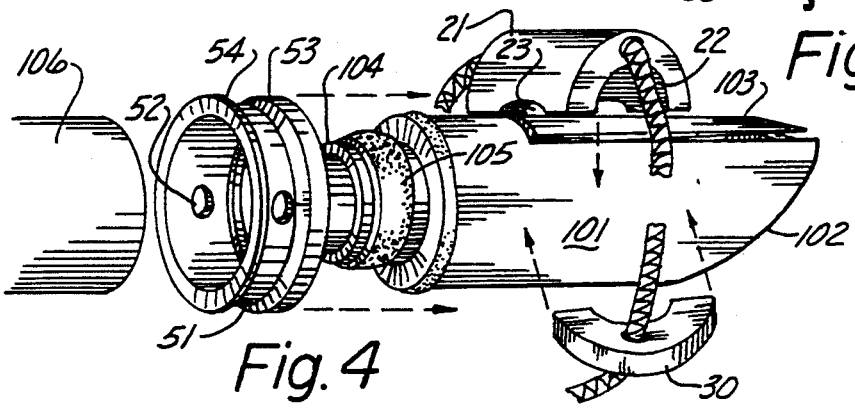
FIG. 4 is a partially exploded perspective view of the arrangement depicted in FIG. 3.
Figure 6:
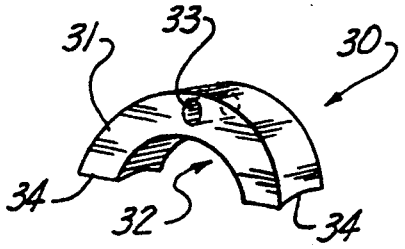
FIG. 6 is an isolated perspective view of one of the spring supporters.
Figure 7:
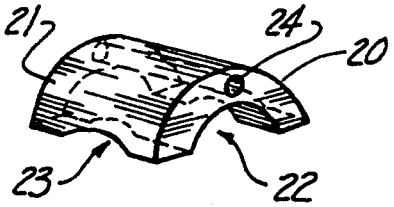
FIG. 7 is an isolated perspective view of the reed clamp.
Figure 8:
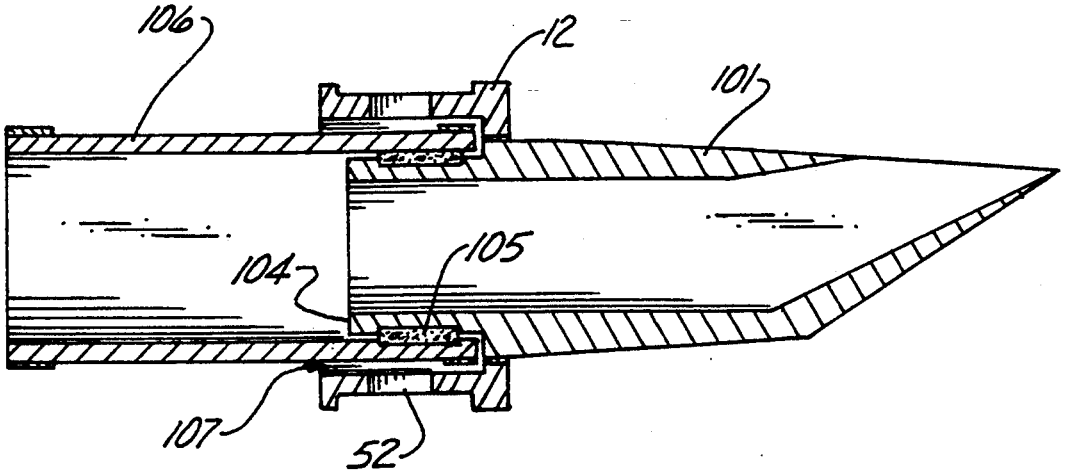
FIG. 8 is an isolated cross sectional view of the operational engagement between the clarinet barrel, the mouthpiece member and the grasping ring.

Turning now to FIGS. 1, 3 and 4, it can be seen that the grasping ring unit (12) comprises a generally short hollow cylindrical grasping ring member (50) having a relatively short and generally truncated hollow cylindrical configuration; wherein, the grasping ring member (50) is provided with a peripheral recess (51) provided with a plurality of apertures (52) disposed at spaced locations around the peripheral recess; wherein the distal end (53) of the grasping ring member (50) defines a relatively thin lip portion and the proximal end (54) of the grasping ring member (50) defines a relatively thick lip portion.

As can best be seen by reference to FIGS. 3 and 4, the grasping ring member (50) is dimensioned to slideably engage the mouthpiece member (101) and be fixedly secured thereto via adhesives or the like (not shown); such that the grasping ring member (50) and mouthpiece member (101) can be removed from the barrel assembly (106) as a single unit, without the need to disturb the operative engagement of the ligature unit (11) with the remainder of the mouthpiece/reed assembly (100).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A clarinet ligature and grasping ring device for use with a mouthpiece/reed assembly which includes a generally cylindrical barrel member having a distal end which is provided with a removable reed element and a proximal end which terminates in a neck portion dimensioned to receive a mouthpiece member; wherein, the device comprises:

a ligature unit including an elongated reed clamp member having an enlarged generally semi-circular recess formed along its longitudinal axis and a discrete elongated bore formed proximate the apex of the semicircular recess; and, a pair of spring support members each comprising a slim profile arched body having a central recess formed therein and an aperture formed proximate the apex of said central recess; and, an elongated spring member dimensioned to be received in said elongated bore and apertures in the reed clamp member and the spring support members respectively; wherein, the opposite ends of the elongated spring member are provided with securing means for releasably securing the opposite ends of the elongated spring member to one another.

2. The device as in claim 1; wherein, the ends of each spring support member are curved to conform to the periphery of said barrel member.

3. The device as in claim 1; wherein, the elongated reed clamp member is further provided with a generally shallow transverse recess that is disposed generally perpendicular to said longitudinally aligned recess, and has the curvature of the reed.

4. The device as in claim 3; wherein, said securing means for releasably securing one end of the elongated spring member to the other end of the elongated spring member comprises hook elements formed on each end of the elongated spring member.

5. The device as in claim 1, further comprising:

a grasping ring unit including a relatively short hollow cylindrical grasping ring member fixedly secured to said mouthpiece member.

6. The device as in claim 5; wherein, said grasping ring member is further provided with a peripheral recess.

7. The device as in claim 6; wherein, the peripheral recess defines a relatively thin lip portion on the distal end of the grasping ring member and a relatively thick lip portion on the proximal end of the gasping ring member.

8. The device as in claim 6; wherein, said peripheral recess is further provided with a plurality of spaced apertures.

9. A clarinet ligature unit for use with a mouthpiece/-reed assembly which includes a generally cylindrical barrel member having a distal end which is provided with a removable reed element and a proximal end which terminates in a reduced neck portion dimensioned to receive a mouthpiece member; wherein, the ligature unit comprises an elongated reed clamp member provided with a first central recess;

a pair of spring support members each having a central recess; and, an elongated spring member for operatively connecting the elongated reed clamp member to said pair of spring support members; wherein, the elongated spring member is further provided with means for releasably securing the opposite ends of the elongated spring to one another.

10. The ligature unit as in claim 9, wherein, the elongated reed clamp member is further provided with an elongated bore dimensioned to receive a portion of said elongated spring member.

11. The ligature unit as in claim 10; wherein, the elongated reed clamp member is further provided with another central recess disposed generally perpendicular to said first central recess.

12. The ligature unit as in claim 9; wherein, each of the spring support members are provided with an aperture dimensioned to receive at least a portion of said elongated spring member.

13. The ligature unit as in claim 9; wherein, the reed clamp member is disposed intermediate said pair of spring support members.

14. The ligature unit as in claim 9; wherein, the bottom of each of said spring support members are curved to conform to the periphery of said mouthpiece member.

* * * * *